US007234647B2

(12) United States Patent
Wirthwein et al.

(10) Patent No.: US 7,234,647 B2
(45) Date of Patent: Jun. 26, 2007

(54) DAMPING DEVICE FOR RAILS

(75) Inventors: Udo Wirthwein, Creglingen (DE); Otto Kaulbersch, Creglingen (DE); Dirk Vorderbrück, Werdohl (DE)

(73) Assignee: Wirthwein AG, Creglingen (DE)

( * ) Notice: Subject to any disclaimer, the term of this patent is extended or adjusted under 35 U.S.C. 154(b) by 78 days.

(21) Appl. No.: 10/510,426

(22) PCT Filed: Apr. 7, 2003

(86) PCT No.: PCT/DE03/01140

§ 371 (c)(1),
(2), (4) Date: Nov. 15, 2004

(87) PCT Pub. No.: WO03/085201

PCT Pub. Date: Oct. 16, 2003

(65) Prior Publication Data

US 2005/0258265 A1 Nov. 24, 2005

(30) Foreign Application Priority Data

Apr. 7, 2002 (DE) ..... 102 15 255

(51) Int. Cl.
*E01B 19/00* (2006.01)

(52) U.S. Cl. ..... 238/382

(58) Field of Classification Search ..... 238/122, 238/125, 127, 139, 149, 150, 382, 2, 3, 8
See application file for complete search history.

(56) References Cited

U.S. PATENT DOCUMENTS 5,622,312 A 4/1997 Martin

FOREIGN PATENT DOCUMENTS

| | | | |
|---|---|---|---|
| DE | 1 784 171 | | 7/1971 |
| DE | 31 47 387 | A1 | 6/1983 |
| DE | 199 19 664 | A1 * | 11/2000 |
| EP | 0 150 264 | B1 | 8/1985 |
| EP | 0 404 756 | B1 | 12/1990 |
| JP | 59122526 | | 7/1984 |
| JP | 07145270 | A * | 6/1995 |

* cited by examiner

*Primary Examiner*—Mark T. Le
(74) *Attorney, Agent, or Firm*—Cohen Pontani Lieberman & Pavane LLP

(57) ABSTRACT

The invention relates to a damping means for damping acoustic vibrations on rails. This damping means is, in particular, a body made of plastics and ferrous materials. The damping means is characterized by a chamber filling body, which consists of a thermoplastic and of metal constituents finely dispersed therein and is produced by extrusion or injection molding, whereby the density of the body is >2.4 g/cm$^3$.

7 Claims, 2 Drawing Sheets

DAMPING DEVICE FOR RAILS

CROSS-REFERENCE TO RELATED APPLICATIONS

This is a U.S. national stage of application No. PCT/DE03/01140, filed on 7 Apr. 2003. Priority is claimed on that application and on the following application(s): Country: Germany, Application No.: 102 15 255.1, Filed: 7 Apr. 2002.

BACKGROUND OF THE INVENTION

Field of the Invention

The invention relates to a damping device for damping acoustic vibrations in rails, especially to bodies made of plastic and ferrous materials, and to a rail provided with the damping device.

A rail with a damping means or damping device to damp acoustic vibrations is known from EP 0 150 264. The damping means is attached to the rail in either an elastic or a rigid manner. The damping means consists of a solid body, a plastic layer and a metal plate or of a concrete body or of a combination of all these, where the body is connected to the rail by way of an intermediate layer of material which remains permanently in a free-flowing state, consisting of a liquid, of a pasty or gel-like mass, or of a kneadable solid substance. In addition, the damping means can be held against one or both sides of the web of the rail by means of an elastic element such as a clamping clip.

These types of damping means are intended to damp the acoustic vibrations produced when wheels travel over the rails and thus to suppress the noise caused by these vibrations.

EP 0 150 264 proceeds from the state of the art according to the publication DE 1 784 171 A1, which describes rails to which metal cover plates are bonded by way of intermediate plastic materials, which are more-or-less incapable of dimensional change. These damping plates have a good sound-damping effect. It is disadvantageous, however, for the plastic material to be attached to the web of the rail, to the base, or to the head of the rail by an adhesive, because welding work is often required on the rail, and the welding can lead to the production of toxic vapors consisting of the original materials out of which the adhesive was made, and it can also cause the adhesive bond to separate.

EP 0 150 264 also cites German Offenlegungsschrift DE 31 47 387 A1, in which it proposes that similar damping plates, i.e., plastic-coated metal plates, be pressed against the rails by the use of springs. The desired damping effect occurs on the basis of molecular displacement in the plastic, which has the effect of destroying the sound-emitting kinetic energy. Because the two components are connected to each other only at certain discrete points and therefore ineffectively, however, full use cannot be made of this mechanism.

In the case of DE 1 784 171 A1, metal plates are bonded to a rail. The plastic which is used as the adhesive consists of a thermosetting plastic in the form of a two-component material based on a filled synthetic resin, such as polyester resin, polyurethane resin, or ethoxyline resin. It is observed here that the rigid plastic, in contrast to other plastics such as rubber, which destroy the sound by flexing work, produces a significant improvement in the noise-damping effect, because it is squeezed between the metal plate and the rail web as a result of the bonding process and is thus subjected to shear. This type of damping has led in practice to a near doubling of efficiency in comparison with conventional sound-deadening coatings subjected only to flexing, even though only very thin plates with thicknesses of less than one millimeter are used.

The type of plastic used is not disclosed in DE 31 47 387. In this publication, use is made of elastic metal clamps of the type normally used to fasten the rails. These clamps are specially shaped to press the plastic-coated plate against the web and also against the head and the base of the rail in the area where the rail is attached. In contrast, EP 0 150 264 discloses a metal clamp which grips the base of the rail from underneath and thus has the overall shape of a "C". Provided that the metal plate and the plastic component are shaped appropriately, this clamp connects the metal plate with its plastic layer to the web on both sides as well as to the base and head of the rail.

It is also disclosed in EP 0 150 264 that vibration and sound absorbers which work on the basis of the known absorption principle or on the basis of the known reflection principle can also be used as a damping device. It is also stated that the damping device can be attached rigidly to the rail, which means that it is very easy to connect parts of concrete and parts of steel. This is based on a damping means design which consists not only of the metal plate but also of a concrete body, which is cast in liquid form into an appropriately shaped metal shell. Instead of the plastic and the metal plate, a form for concrete can be placed on the rail, and the liquid concrete can then be poured into this form. In these cases, care must be taken to ensure that a permanently free-flowing element, such as a liquid-saturated elastic foam, a water-filled gap, or some other pasty, gel-like, or kneadable substance is provided as the permanently free-flowing mass located between the concrete and/or the plastic-coated metal plate and the rail.

It is generally known from real-world experience that recess-filling bodies, which are generally used as damping and/or insulation, i.e., as absorbers and/or reflectors, in the "fishplate recess", i.e., in the rail recess, can be connected to the web or to the head and/or to the base of the rail by means of bitumen or some other type of adhesive.

SUMMARY OF THE INVENTION

An object of the present invention is to provide an improved solution for a damping device, especially for filling bodies, for the rails of a railroad.

The problem is solved according to the invention by the features of the independent claim. Elaborations of the invention are covered in the subclaims.

As already mentioned in connection with the state of the art, the plastic should be subjected to shear, so that the vibration energy in the rails can be absorbed by frictional energy. The only way to do this, however, is by exploiting the inertia of the metal plate or of the connected concrete masses, this inertia being greater than that of the plastic, which can be put into a state of vibration more quickly.

In pursuing this basic idea, the inventors found that the effect can be enhanced by the use of larger masses. To reduce the installation work, a homogeneous body according to the invention is connected to the rail, which body is produced separately by extrusion or injection-molding in lengths of 200–2,000 mm and which consists essentially of a thermoplastic material filled with metal components. Suitable thermoplastics are polyethylene and polypropylene.

After the plastication of the thermoplastic in an extruder, a metal component, preferably a pure ore of hematite or magnetite or mixtures of the two with the smallest possible grain size, i.e., a size which does not interfere with the extrusion or injection-molding process, is then added to the extruder before the extrusion or injection-molding or press-molding. In view of the fact that the recess-filling body used to fill up the "fishplate recess" between the head and the base of the rail is relatively large and requires correspondingly large cross sections, the grain size of the metal component can be relatively large.

Experiments have shown that rolling scale, which contains certain amounts of FeO and impurities in addition to $Fe_2O_3$ and $Fe_3O_4$, can also be used, but the pure ores are preferred.

Whereas thermoplastics have a specific gravity or density of 0.9–1.0 g/cm$^3$, hematite and magnetite have a density of approximately 5.2–5.3 g/cm$^3$. They, too, like pure washed ores, are easy to handle and do not generate any dust and therefore can be used directly in the injection-molding or extrusion process. The metal components are completely surrounded by the thermoplastic material, so that, according to this method, a completely homogeneous body with a plastic surface is obtained. To achieve a specific gravity or density of >2.4 g/cm$^3$, the hematite portion or the magnetite portion or the mixture of the two should make up 35–70% of the volume of the body, which leads to a specific gravity which, according to the experiments conducted by the inventors, should be in the range of 2.5–3.9 g/cm$^3$, and preferably 2.9–3.5 g/cm$^3$. In terms of the amount of added metal component, this is a compromise to ensure good processability in, for example, an extruder with an appropriate die, which has been custom-made to suit the cross section of the fishplate recess.

A body produced in this way, especially a recess-filling body designed to essentially fill up the recess completely and therefore with the cross-sectional dimensions of the fishplate surface recess of the rail, can be connected to the web of the rail and/or to the head or to the base of the rail by means of a free-flowing intermediate layer and/or a metal clamp in the manner known from EP 0 150 264 A1. The connection method, like the length of the usable recess-filling bodies, which are relatively stiff and heavy, deviates from the conventional method of attachment to the rail. Along certain streets, grooved rails are often used, whereas Vignoles rails are most often used on open stretches. The fishplate recess will therefore be designed differently as required, and the method of attachment to the base will be adjusted accordingly. Vignoles rails will usually be laid on ties, whereas streetcar tracks with grooved rails are often laid with the help of spacers, the gage rods, on longitudinal foundations.

Accordingly, a recess-filling body must be designed differently in some cases, so that it can be integrated into the attachment of the roadbed or so that it offers a free space at these points to allow the attachment to take place.

DETAILED DESCRIPTION OF THE PRESENT INVENTION

Figure 1:
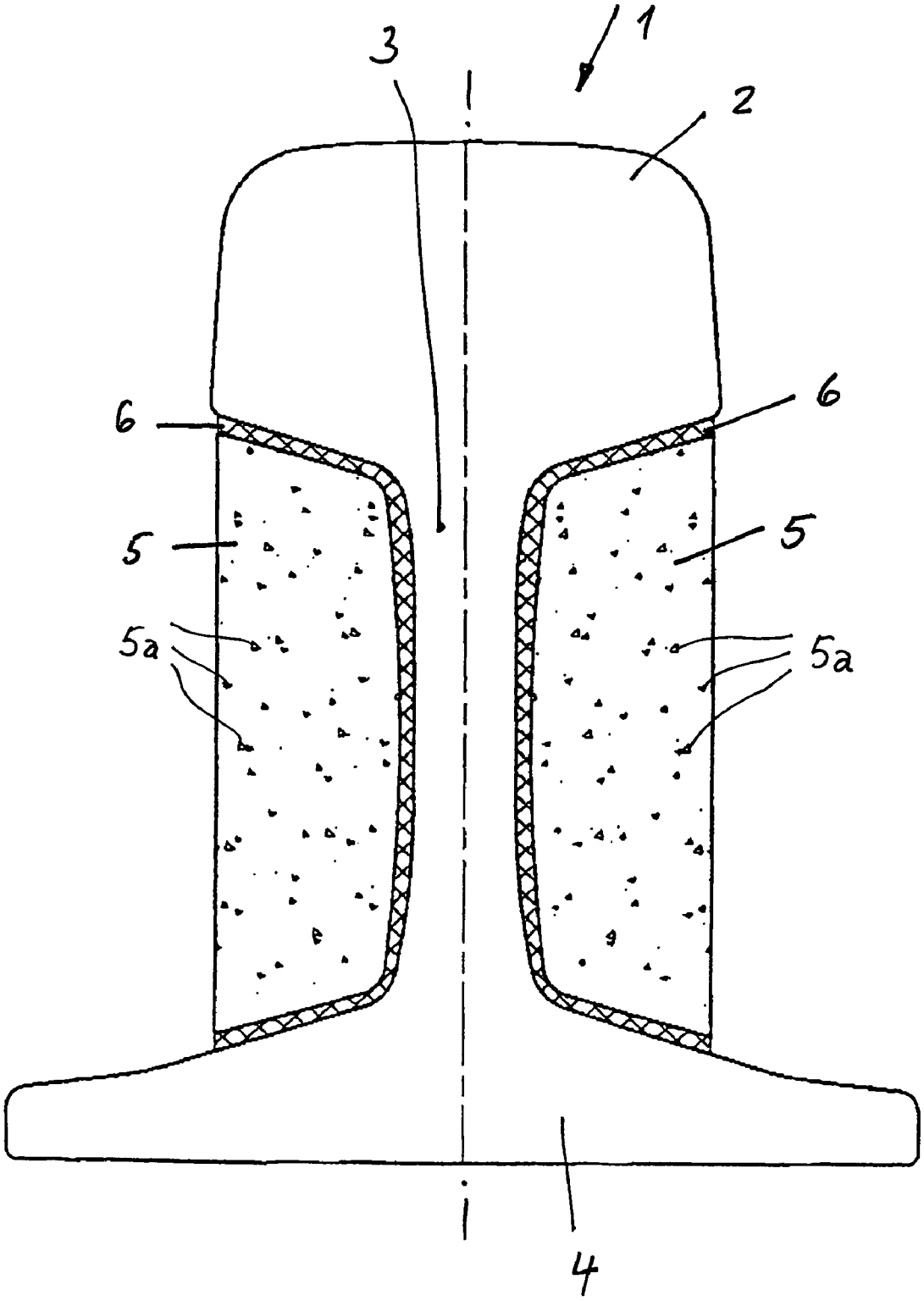
FIG. 1 is an end view of a rail including a damping device according to a first embodiment of the invention.
Figure 2:
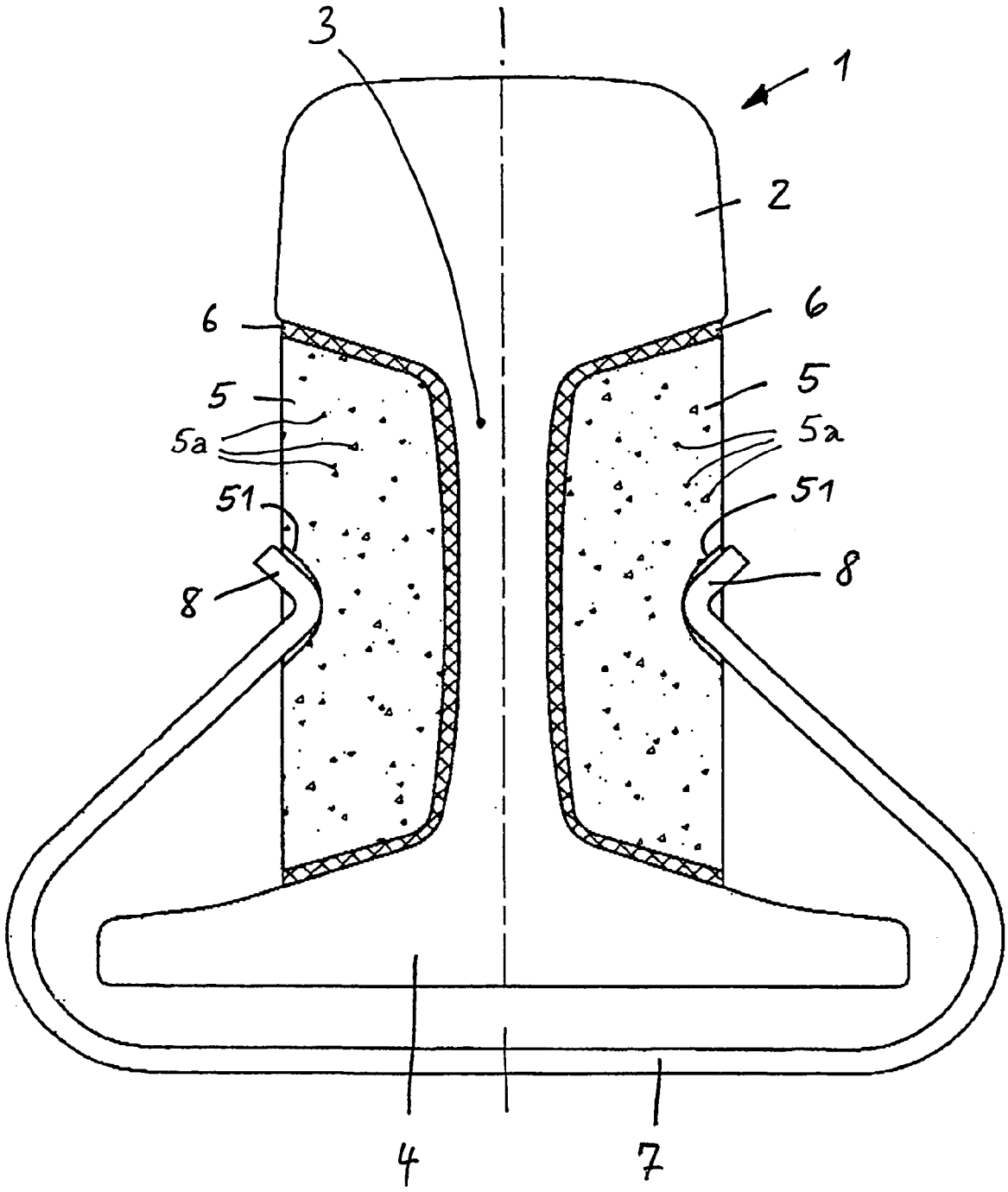
FIG. 2 is an end view of a rail including a damping device according to a second embodiment of the invention.

A rail 1, seen in FIGS. 1 and 2 from the end, has a head 2, a web 3, and a base 4. A fishplate recess or rail recess is thus created along the web, between the head and the base.

FIG. 1 shows a damping means in the form of a recess-filling body 5, which fills the recess completely on both sides of the web 3. The recess-filling body is connected by an adhesive layer 6, which is shown here as completely filling the gap between the head 2, web 3, and base 4 and the recess-filling body 5. It is equally possible, however, to provide adhesive, i.e., a gap to accept the adhesive, only on the web or only on the base, because the web and the base are the parts of the rail which radiate the most troublesome vibrations as a result of their small dimensions. Although the finely distributed metal component 5*a* made of ore are visible in the illustration of the recess-filling body, the recess-filling body is made in such a way that it feels from the outside as if it were all plastic, even though it is extremely heavy. The metal components 5*a* more precisely the hematite and magnetite components, cannot be felt or recognized as such. A rail of this type can be produced in the conventional manner and then provided with a recess-filling body of this type, or the body can be installed right at the factory. The expert can also coat the recess-filling body 5 with another layer of plastic between the adhesive layer and the recess-filling body, if it is desired to adjust the softness of the surface to a different value. This can also be done on the side facing away from the rail in cases where that side is to be in contact with paving material, for example, and additional insulation between the paving and the recess-filling body is to be provided there. This depends on the specific type of environment of the recess-filling body and of the rail.

FIG. 2 shows a recess-filling body 5 arranged in a manner similar to that of FIG. 1, but in this case a depression 51 is provided. A metal clamp 7, which holds the recess-filling body 6 in position against the web 3, extends between the two depressions 51. This design can be used in addition to a layer of adhesive 6 to increase the pressure exerted by the recess-filling body 6 on the web and thus to improve the connection between the recess-filling body and the web 3. Instead of an adhesive layer 6, however, the recess-filling body can also be coated with a plastic layer which fills up the joint otherwise occupied by the adhesive, especially when the rail has considerable rolling tolerances, which slightly increase the quality of the connection by positive engagement.

Clamp designs different from that shown here can also be used.

The recess-filling body is produced in the lengths required on site. Over open stretches of streetcar tracks which do not have rail base attachments of the conventional type, the bodies can be as much as 1 m long; otherwise, the length and shape of the recess-filling body will be adapted to the manner of rail attachment.

The invention claimed is:

1. A combination including a rail and a damping device, said rail having a recess, said damping device comprising a recess-filling body adapted to fill the recess of the rail, said recess-filling body comprising one of an extruded and injection molded body material including a thermoplastic material with metal components distributed therein, wherein the density of said body material is greater than 2.4 g/cm$^3$, said recess filling body being received in said recess and connected to said rail by at least one of a permanently free flowing intermediate layer and a metal clip.

2. The combination of claim 1, wherein said recess comprises a fishplate recess on said rail.

3. The combination of claim 1, wherein said density of said body material is in the range 2.5–3.9 g/cm$^3$.

4. The combination of claim 1, wherein said density of said body material is in the range 2.9–3.5 g/cm$^3$.

5. The combination of claim 1, wherein said thermoplastic material is one of the group consisting of polyethylene and polypropylene.

6. The combination of claim 1, wherein said metal components comprise at least one of hematite and magnetite and comprise 35–70% volume of said body material.

7. The combination of claim 1, wherein said metal components comprise roll scale.

* * * * *